US012054689B2

(12) United States Patent
Bargon et al.

(10) Patent No.: US 12,054,689 B2
(45) Date of Patent: Aug. 6, 2024

(54) COMPOSITION FOR LUBRICATING AND/OR DESCALING DURING HOT WORKING OF METALS

(71) Applicant: Chemische Fabrik Budenheim KG, Budenheim (DE)

(72) Inventors: Marvin Bargon, Budenheim (DE); Steffen Bugner, Budenheim (DE); Dirk Masurat, Eltville (DE); Andrej Weber, Heidesheim (DE)

(73) Assignee: Chemische Fabrik Budenheim KG, Budenheim (DE)

( * ) Notice: Subject to any disclaimer, the term of this patent is extended or adjusted under 35 U.S.C. 154(b) by 0 days.

(21) Appl. No.: 17/911,578

(22) PCT Filed: Mar. 2, 2021

(86) PCT No.: PCT/EP2021/055199
§ 371 (c)(1),
(2) Date: Sep. 14, 2022

(87) PCT Pub. No.: WO2021/185568
PCT Pub. Date: Sep. 23, 2021

(65) Prior Publication Data

US 2023/0357662 A1 Nov. 9, 2023

(30) Foreign Application Priority Data

Mar. 16, 2020 (DE) ..... 10 2020 107 159.0
Oct. 12, 2020 (DE) ..... 10 2020 126 746.0

(51) Int. Cl.

| | |
|---|---|
| ***C10M 141/02*** | (2006.01) |
| ***C10M 125/22*** | (2006.01) |
| ***C10M 125/24*** | (2006.01) |
| ***C10M 125/26*** | (2006.01) |
| ***C10M 129/30*** | (2006.01) |
| ***C10M 129/38*** | (2006.01) |
| ***C23G 5/00*** | (2006.01) |
| *C10N 10/02* | (2006.01) |
| *C10N 40/20* | (2006.01) |
| *C10N 50/08* | (2006.01) |

(52) U.S. Cl.
CPC ..... *C10M 141/02* (2013.01); *C10M 125/22* (2013.01); *C10M 125/24* (2013.01); *C10M 125/26* (2013.01); *C10M 129/30* (2013.01); *C10M 129/38* (2013.01); *C23G 5/00* (2013.01); *C10M 2201/084* (2013.01); *C10M 2201/085* (2013.01); *C10M 2201/087* (2013.01); *C10M 2207/122* (2013.01); *C10M 2207/126* (2013.01); *C10N 2010/02* (2013.01); *C10N 2040/241* (2020.05); *C10N 2040/242* (2020.05); *C10N 2040/246* (2020.05); *C10N 2050/08* (2013.01)

(58) Field of Classification Search
CPC ..... C10M 141/02; C10M 125/22; C10M 125/24; C10M 125/26; C10M 129/30; C10M 129/38; C10M 2201/084; C10M 2201/085; C10M 2201/087; C10M 2207/122; C10M 2207/126; C23G 5/00; C10N 2010/02; C10N 2040/241; C10N 2040/242; C10N 2040/246; C10N 2050/08
See application file for complete search history.

(56) References Cited

U.S. PATENT DOCUMENTS

| | | | | |
|---|---|---|---|---|
| 4,197,340 | A * | 4/1980 | Brown | C10M 3/00 427/397.8 |
| 4,532,055 | A * | 7/1985 | Eguchi | B29C 48/94 508/137 |
| 4,710,307 | A | 12/1987 | Periard et al. | |
| 4,923,625 | A * | 5/1990 | King | C10M 125/00 508/163 |
| 5,445,748 | A * | 8/1995 | Holinski | H01R 39/56 106/38.27 |
| 5,691,282 | A | 11/1997 | Periard et al. | |
| 10,995,297 | B2 | 5/2021 | Bugner et al. | |
| 2003/0216265 | A1* | 11/2003 | Zepf | C10M 173/00 508/423 |
| 2010/0298181 | A1* | 11/2010 | Bugner | C10M 169/04 508/158 |
| 2016/0215232 | A1* | 7/2016 | Bugner | C10M 141/02 |
| 2022/0064565 | A1* | 3/2022 | Kogel | C10M 173/02 |

FOREIGN PATENT DOCUMENTS

| | | | |
|---|---|---|---|
| CN | 85103499 | A | 10/1986 |
| DE | 235676 | A5 | 5/1986 |
| DE | 10 2013 102 897 | A1 | 9/2014 |
| EP | 0164637 | A1 | 12/1985 |
| EP | 0169413 | A2 | 1/1986 |
| EP | 0743352 | B1 | 7/1999 |
| GB | 0884748 | A | 12/1961 |
| JP | 61-037989 | A | 2/1986 |
| JP | 10-036876 | A | 2/1998 |

(Continued)

*Primary Examiner* — Ellen M McAvoy
(74) *Attorney, Agent, or Firm* — Faegre Drinker Biddle & Reath LLP

(57) ABSTRACT

A composition for lubricating and/or descaling in the hot processing of metals includes a solid mixture containing the following constituents:

(a) 20 to 60% by weight of condensed alkali phosphate,
(b) 10 to 40% by weight boron compound selected from borosilicate glass, boric acid, boric acid salt, or a mixture thereof,
(c) 10 to 30% by weight alkali or alkaline earth sulphates,
(d) 5 to 25% by weight fatty acid, fatty acid salt, or a mixture thereof. The sum of the constituents (a) and (b) constitutes at least 50% by weight of the mixture and the sum of the constituents (a) to (d) constitutes at least 85% by weight of the mixture.

13 Claims, No Drawings

(56) References Cited

FOREIGN PATENT DOCUMENTS

| | | | |
|---|---|---|---|
| JP | 2000-226591 | A | 8/2000 |
| JP | 2006-182927 | A | 7/2006 |
| JP | 2016-519701 | A | 7/2016 |

* cited by examiner

COMPOSITION FOR LUBRICATING AND/OR DESCALING DURING HOT WORKING OF METALS

CROSS-REFERENCE TO RELATED APPLICATIONS

This application is a National Stage of International Application No. PCT/EP2021/055199 filed on Mar. 2, 2021, which claims benefit of German Patent Application No. 10 2020 107 159.0 filed Mar. 16, 2020 and German Patent Application No. 10 2020 126 746.0 filed Oct. 12, 2020, each of which are herein incorporated by reference in their entirety.

SUBJECT MATTER OF THE INVENTION

The present invention relates to a composition for lubricating and/or descaling in the hot processing of metals, wherein the composition consists of a solid mixture. The present invention also encompasses the use of the composition according to the invention in the hot processing of metals, wherein the composition is applied to the metal in powder form or granule form.

BACKGROUND OF THE INVENTION

Descaling agents are typically mixtures of solids that are pneumatically introduced into the interior of the resulting hollow block immediately after the piercing process. When contacted with the hot steel surface of approximately 900-1250° C., the solid mixture melts and reacts with the hard scale, which immediately forms through a reaction with the atmospheric oxygen and consists primarily of layers of FeO (wüstite), $Fe_3O_4$ (magnetite) and $Fe_2O_3$ (haematite).

For the modern continuous rolling processes with the bar held, the so-called "descaling" of the hollow block inner surface is an unavoidable technologically necessary process step. Without this step, the friction force caused by the scale between the tool (mandrel bar) usually coated with a solid lubricant (generally graphite-based) and the rolled material (hollow block of steel) increases so much that a so-called "plug" can occur. If a "plug" actually occurs, the rolled material cannot be rolled out and remains in the rolling stands so that continuous seamless tube production must be stopped in order to eliminate the plug.

In addition, unconverted scale may damage the inner surface of the tube, thereby reducing the quality of the tube produced. Furthermore, scale may cause damage to mandrel bars, which significantly affects the economy of the production process since the costs of tools are comparatively high.

In the manufacture of a seamless steel tube by a rolling process, high-temperature lubricants are used. Many conventional high-temperature lubricants are based on a mixture of borax and sulphates. Other high-temperature lubricants known in the art are based on condensed phosphates or borates.

Phosphate-based formulations are relatively sensitive and complex in practice and do not forgive any errors. In particular, when applying the solid mixture via pneumatic blow-in systems, attention must be paid to the dosing and adherence to relatively narrow limits in the settings of the systems in order to achieve an even distribution of the amount of lubricant on the entire inner surface of the hollow block. Especially local overdoses in the hollow block increase the risk of internal defects when rolling out the steel tubes.

Although borax-based formulations have proven to be very reliable and relatively simple to handle (especially with regard to overdosing). However, major drawbacks of borax-based formulations are the lack of additional lubrication in comparison to phosphate-based formulations and the propensity to clump through water absorption at increased humidity.

High-temperature lubricants based on condensed phosphates and having a proportion of borates are also known from the prior art. Especially the proportion of water-soluble borates is usually however deliberately kept low (e.g., DE 10 2013 102 897) due to existing ecological and toxicological risks.

Object of the Invention

In light of the aforesaid, the object of the present invention was to provide a composition for lubricating and/or descaling in the hot processing of metals without the disadvantages observed in the conventional high-temperature lubricants described above, such as local overdose or clumping.

DESCRIPTION OF THE INVENTION

According to the invention, this object is achieved by a composition for lubricating and/or descaling in the hot processing of metals, wherein the composition consists of a solid mixture containing the following constituents:

(a) 20 to 60% by weight of condensed alkali phosphate,
(b) 10 to 40% by weight boron compound selected from borosilicate glass, boric acid, boric acid salt, or a mixture thereof,
(c) 10 to 30% by weight alkali or alkaline earth sulphates,
(d) 5 to 25% by weight fatty acid, fatty acid salt, or a mixture thereof, with the proviso that the sum of the constituents (a) and (b) constitutes at least 50% by weight of the mixture and the sum of the constituents (a) to (d) constitutes at least 85% by weight of the mixture.

It has surprisingly been shown that the composition according to the invention is very well suited as a descaling agent and as a lubricant for the hot processing of metals. This is in particular due to the balanced ratio of the components (a) condensed alkali phosphate and (b) boron compound and the sum of the constituents (a) and (b) constituting at least 50% by weight of the mixture. In certain embodiments, the sum of the constituents (a) and (b) even constitutes at least 60% by weight of the mixture.

Due to the proportion of boron compound according to the invention, the composition proposed herein is capable of chemically converting scales very effectively. In addition, a pickling reaction also takes place on the steel surface, resulting in higher quality. Furthermore, the composition according to the invention has proven to be very reliable and relatively simple to handle (especially with regard to overdosing).

The proportion of condensed alkali phosphate according to the invention ensures that a high-temperature-stable hydrodynamic lubricating film forms, which is demonstrably leading to a reduction in the rolling force. It has also been shown that this effectively reduces the risk of secondary scaling. The lubricating effect imparted by the proportion of condensed alkali phosphate protects the tool (mandrel bar) against wear and thus increases its service life.

The proportions of alkali or alkaline earth sulphate and fatty acid, fatty acid salt, or a mixture thereof provided according to the invention also cause the composition according to the present invention not to have the disadvantages as can be observed with the conventional high-temperature lubricants described above, such as local overdose or clumping.

In particular, the composition according to the present invention may be dosed via pneumatic blow-in systems with relatively wide tolerance ranges within which an even distribution of the amount of lubricant is achieved on the entire inner surface of the hollow block. The risk of local overdoses in the hollow block is thus reduced. Moreover, the composition according to the present invention does not tend to clump, even at elevated humidity.

The condensed alkali phosphates (a) used according to the invention may be polyphosphates, pyrophosphates, metaphosphates, or mixtures thereof. In certain embodiments of the invention, the condensed alkali phosphate (a) is selected from condensed sodium or potassium phosphates or mixtures thereof.

In specific embodiments of the invention, the condensed alkali phosphate (a) is selected from disodium pyrophosphate [$Na_2H_2P_2O_7$], trisodium pyrophosphate [$Na_3HP_2O_7$], tetrasodium pyrophosphate [$Na_4P_2O_7$], sodium tripolyphosphate [$Na_5P_3O_{10}$], sodium trimetaphosphate [$(NaPO_3)_3$], sodium polyphosphate [$(NaPO_3)_n$], dipotassium pyrophosphate [$K_2H_2P_2O_7$], tripotassium pyrophosphate [$K_3HP_2O_7$], tetrapotassium pyrophosphate [$K_4P_2O_7$], potassium tripolyphosphate [$K_5P_3O_{10}$], potassium trimetaphosphate [$(KPO_3)_3$], potassium polyphosphate [$(KPO_3)_n$], or mixtures thereof.

According to the present invention, the proportion of condensed alkali phosphate (a) is 20 to 60% by weight of the mixture. In certain embodiments of the invention, the proportion of condensed alkali phosphate (a) is 30 to 50% by weight of the mixture. In specific embodiments of the invention, the proportion of condensed alkali phosphate (a) is 35 to 45% by weight of the mixture.

The boron compound (b) used according to the invention may be borosilicate glass, boric acid, boric acid salt, or a mixture thereof. In certain embodiments of the invention, the boron compounds (b) are selected from boric acid [$H_3BO_3$], sodium borates, boric anhydride [$B_2O_3$], borosilicate glass, and mixtures thereof.

In specific embodiments of the invention, the boron compound (b) used according to the invention has or consists of a proportion of sodium borate, wherein the sodium borate is selected from sodium tetraborate and its hydrate stages [$Na_2B_4O_7$ x $H_2O$], in particular anhydrous sodium tetraborate [$Na_2B_4O_7$], sodium tetraborate pentahydrate [$Na_2B_4O_7 \cdot 5H_2O$], sodium tetraborate decahydrate [$Na_2B_4O_7 \cdot 10H_2O$], sodium metaborate [$NaB_2 \cdot 4H_2O$], and mixtures thereof.

According to the present invention, the proportion of boron compound (b) is 10 to 40% by weight of the mixture. In certain embodiments of the invention, the proportion of boron compound (b) is 15 to 35% by weight of the mixture. In specific embodiments of the invention, the proportion of boron compound (b) is 20 to 30% by weight of the mixture.

Preferably, the solid mixture of the present invention contains only a small proportion of soluble borates or boric acid since these have a high risk potential for humans and the environment. Instead, the boron compound according to component b) preferably consists of at least 70% by weight, at least 80% by weight, or even at least 90% by weight of borosilicate glass. Borosilicate glass is advantageous in this regard because the borate content in the ground borosilicate glass is poorly water soluble so that the high requirements of the applicable waste water regulations are easier to meet.

In cooperation with the boron compound used according to the invention, the sulphates used according to the invention form a particularly good pickling agent and thus make a significant contribution to improving the quality of the steel surface.

The sulphates (c) used according to the invention may be alkali or alkaline earth sulphates or mixtures thereof. Alkali sulphates have a comparatively low melting point and therefore transition relatively quickly to the liquid phase during the application, which is desired in most cases. Alkaline earth sulphates have a higher melting point.

In certain embodiments of the invention, the alkali or alkaline earth sulphate (c) is an alkali sulphate that is selected from sodium or potassium sulphate, potassium hydrogen sulphate, or mixtures thereof.

According to the present invention, the proportion of alkali or alkaline earth sulphate (c) is 10 to 30% by weight of the mixture. In certain embodiments of the invention, the proportion of alkali or alkaline earth sulphate (c) is 15 to 25% by weight of the mixture. In specific embodiments of the invention, the proportion of alkali or alkaline earth sulphate (c) is 18 to 22% by weight of the mixture.

The fatty acids used according to the invention or the fatty acid salt (d) react with atmospheric oxygen (combustion) in the range of use of 600-1300° C. and reduce the further scaling of the steel. Moreover, it has been shown that by admixing the proportion provided according to the invention of a fatty acid or a fatty acid salt, the clumping of fine-grained solid mixtures can in particular be significantly reduced and the shelf life can be improved.

The fatty acid (d) used according to the invention or its salt may be a saturated or unsaturated fatty acid having 6 to 26 carbon atoms or its salt, or a mixture thereof, with the proviso that the fatty acid or the fatty acid salt is present as a solid at 30° C. In certain embodiments, the chain length of the fatty acids used is in the range of 10 to 24 carbon atoms, particularly preferably in the range of 12 to 22 carbon atoms.

In certain embodiments of the invention, the fatty acid (d) used or its salt is selected from caproic acid, caprylic acid, capric acid, lauric acid, myristic acid, palmitic acid, margaric acid, stearic acid, arachidic acid, behenic acid, lignoceric acid, cerotic acid, palmitoleic acid, oleic acid, elaidic acid, vaccenic acid, eicosenoic acid, erucic acid, nervonic acid, linoleic acid, linolenic acid, arachidonic acid, timnodonic acid, clupanodonic acid, etc., their salts, and mixtures thereof.

According to the present invention, the proportion of fatty acid (d) or its salt is 5 to 25% by weight of the mixture. In certain embodiments of the invention, the proportion of fatty acid or fatty acid salt (d) is 10 to 20% by weight of the mixture. In certain embodiments of the invention, the proportion of fatty acid or fatty acid salt (d) is 12 to 18% by weight of the mixture.

It is understood that the lubricant according to the invention may contain further constituents as long as they do not significantly negatively affect the desired advantageous properties and with the proviso that the sum of the constituents (a) to (d) constitutes at least 85% by weight of the mixture. In certain embodiments of the invention, the sum of the constituents (a) to (d) constitutes at least 90% by weight, at least 95% by weight, or even at least 98% by weight of the mixture.

Examples of further constituents that may be contained in the composition according to the invention and that do not disadvantageously but even positively affect the desired advantageous properties are secondary or tertiary calcium phosphate compounds, hydroxyapatite, graphite, or mixtures thereof.

Furthermore, anticaking agents may, for example, be contained in the composition according to the invention as further constituents. Typical anticaking agents are silica, calcium carbonate, alkali hexacyanoferrate, aluminium silicates, or aluminium hydroxide. Preferably, hydrophobic pyrogenic silica is used, which is available, e.g., with a $SiO_2$ content of >98% by weight based on the annealed substance under the brand name Aerosil 972 from the company Evonik.

In embodiments containing graphite as an additional constituent (e2), this proportion may be in the range of up to 15% by weight. In embodiments containing a secondary or tertiary calcium phosphate compound, hydroxyapatite, or a mixture thereof as an additional constituent (e1), this proportion may be in the range of up to 10% by weight. If both graphite and secondary or tertiary calcium phosphate compound, hydroxyapatite, or a mixture thereof are contained, or a combination of one or more of these components with a further additional constituent, the sum of these proportions is at most 15% by weight of the composition according to the invention.

In certain embodiments of the invention, a proportion of graphite may make an additional contribution to the lubricating effect of the composition. Secondary and/or tertiary calcium phosphate compounds as well as apatite are particularly suitable anticaking agents for compositions of the type according to the invention for the hot processing of metals.

In embodiments containing a secondary or tertiary calcium phosphate compound, hydroxyapatite, or a mixture thereof as an additional constituent (e1), this constituent in certain embodiments consists of hydroxyapatite $[Ca_5(PO_4)_3OH]$, tricalcium phosphate $[Ca_3(PO_4)_2]$, or a mixture thereof.

The solid mixture of the present invention is preferably present in powder form or granule form.

In the powdered embodiments, the mixture comprises particles having a size in the range of 1 μm to 1000 μm. The particle size of the powdered mixture is determined by means of a laser granulometer (e.g., Cilas Model 715/920 of the company Cilas U.S. Inc.). In doing so, approximately 80 mg sample are suspended in 2-propanol and the measurement is performed according to the manufacturer's instructions one minute after preparation of the suspension.

In the granular embodiments, the size of the granules ranges from 1 mm to 30 mm. This includes embodiments with spherical grains as well as agglomerates and cylindrical pellets as well as transition forms, with the proviso that the largest longitudinal extent of the grains, agglomerates, and pellets in one dimension does not exceed 30 mm. The maximum size of the longitudinal extent of the grains, agglomerates, and pellets in one dimension is determined by mechanical sieving.

Powdered embodiments may be applied by spraying onto the surfaces, whereby a very uniform layer formation or coating can be achieved on the metal surface. The special combination and proportional distribution of the constituents of the mixture according to the invention reduces the tendency to clump, which may otherwise occur regularly in lubricants with small grain sizes and lead to significant disadvantages.

The invention also includes use of the composition according to the invention for lubricating and/or descaling in the hot processing of metals, wherein the composition is applied to, preferably blown onto, the metal to be processed in powder form or in granule form.

EXAMPLES

Tables 1 to 3 below indicate compositions according to the invention.

TABLE 1

| % by weight | Example A |
|---|---|
| 20 | Sodium tripolyphosphate, $Na_5P_3O_{10}$ |
| 20 | Sodium sulphate, $Na_2SO_4$ |
| 15 | Fatty acid salt ($C_{16}$-$C_{24}$) |
| 25 | Sodium tetraborate pentahydrate, $Na_2B_4O_7 * 5H_2O$ |
| 20 | Sodium trimetaphosphate, $(NaPO_3)_3$ |

TABLE 2

| % by weight | Example B |
|---|---|
| 40 | Sodium tripolyphosphate, $Na_5P_3O_{10}$ |
| 20 | Sodium sulphate, $Na_2SO_4$ |
| 15 | Fatty acid salt ($C_{10}$-$C_{20}$) |
| 25 | Sodium tetraborate pentahydrate, $Na_2B_4O_7 * 5H_2O$ |

TABLE 3

| % by weight | Example C |
|---|---|
| 15 | Sodium tripolyphosphate, $Na_5P_3O_{10}$ |
| 20 | Sodium sulphate, $Na_2SO_4$ |
| 15 | Fatty acid salt ($C_{14}$-$C_{22}$) |
| 6 | Sodium tetraborate pentahydrate, $Na_2B_4O_7 * 5H_2O$ |
| 10 | Sodium trimetaphosphate, $(NaPO_3)_3$ |
| 15 | Boron glass frit |
| 15 | Sodium hexametaphosphate, $(NaPO_3)_n$ |
| 4 | Hydroxyapatite, $Ca_5(PO_4)_3(OH)$ |

With the compositions according to examples A to C, friction value measurements were carried out with the tribometer "HT-Tribometer Prüfstand 564" from the company Lohrentz GmbH Prüftechnik, Nidda-Harb, Germany. The tribometer consists of an inductively heatable rotating disc made of Thermodur 2342 EFS steel having a diameter of 280 mm and a table hydraulically extendible towards the rotating disc on which a resistively heatable specimen made of S355MC steel is mounted.

For the friction value measurements, the rotating disc was provided with a thin adhesive layer and coated with a defined layer thickness with the composition to be investigated in powder form. Unless expressly stated otherwise, the composition was applied in a layer thickness of 200 g/m$^2$.

In the subsequent measurement, the disc was rotated at 10 rpm. The specimen was heated to 1230° C. (±20° C.), pressed against the rotating disc by means of the hydraulically moveable table with a pressing force ($F_N$) of 32,000 N (±2,000 N), and the radial force ($F_R$) acting on the disc perpendicularly to the pressing force was measured over a period of several seconds.

The friction value (μ) is the quotient of radial force ($F_R$) and pressing force ($F_N$), $\mu=F_R/F_N$. Six measurements were taken with each sample (6-fold determination). The average value of the detected friction values in the period of 2 to 6 seconds after contact of the work piece with the rotating disk was respectively considered as the friction value of a measurement. Again, the friction value given herein is the average value of five measurements taken with each sample.

The mean friction values determined in this manner are summarized in Table 4 below.

TABLE 4

| Example | A | B | C |
|---|---|---|---|
| Mean friction value [μ] | 0.132 | 0.115 | 0.129 |

Comparative Examples

In order to be able to compare the lubricating effect of the compositions according to the invention with the compositions known from the prior art, the mean friction value [μ] was determined for conventional compositions according to the method described above.

Tables 5 to 6 below indicate compositions of the comparative examples.

TABLE 5

| % by weight | Comparative example V1 |
|---|---|
| 85 | Alkali phosphate |
| 10 | Boron compound |
| 5 | Fatty acid salt |

TABLE 6

| % by weight | Comparative example V2 |
|---|---|
| 50 | Borax |
| 30 | Alkali sulphate |
| 15 | Fatty acid salt |

The mean friction values [μ] determined for these two comparative compositions are summarized in Table 7 below.

TABLE 7

| Example | V1 | V2 |
|---|---|---|
| Mean friction value [μ] | 0.108 | 0.150 |

The measurements show that the compositions according to the invention lubricate significantly better than the composition of example V2, which consists largely of a mixture of borax and alkali sulphate.

The compositions according to the invention also partially achieve friction values that are almost as good as that of the composition of example V1, which largely consists of alkali phosphate, without the risk that internal errors occur during the rolling out of the steel tubes due to local overdoses in the hollow block.

The invention claimed is:

1. A composition for lubricating and/or descaling in the hot processing of metals, wherein the composition consists of a solid mixture containing the following constituents:

(a) 20 to 60% by weight of condensed alkali phosphate, (b) 10 to 40% by weight boron compound selected from borosilicate glass, boric acid, boric acid salt, or a mixture thereof, (c) 10 to 30% by weight alkali or alkaline earth sulphates, (d) 5 to 25% by weight fatty acid, fatty acid salt, or a mixture thereof, with the proviso that the sum of the constituents (a) and (b) constitutes at least 50% by weight of the mixture and the sum of the constituents (a) to (d) constitutes at least 85% by weight of the mixture.

2. The composition according to claim 1, wherein the condensed alkali phosphate (a) is selected from condensed sodium or potassium phosphates or mixtures thereof.

3. The composition according to claim 1, wherein the condensed alkali phosphate (a) is selected from polyphosphates and/or pyrophosphates and/or metaphosphates or mixtures thereof.

4. The composition according to claim 1, wherein the condensed alkali phosphate (a) is selected from disodium pyrophosphate [$Na_2H_2P_2O_7$], trisodium pyrophosphate [$Na_3HP_2O_7$], tetrasodium pyrophosphate [$Na_4P_2O_7$], sodium tripolyphosphate [$NasP_3O_{10}$], sodium trimetaphosphate [$(NaPO_3)_3$], sodium polyphosphate [$(NaPO_3)_n$], dipotassium pyrophosphate [$K_2H_2P_2O_7$], tripotassium pyrophosphate [$K_3HP_2O_7$], tetrapotassium pyrophosphate [$K_4P_2O_7$], potassium tripolyphosphate [$K_5P_3O_{10}$], potassium trimetaphosphate [$(KPO_3)_3$], potassium polyphosphate [$(KPO_3)_n$], or mixtures thereof.

5. The composition according to claim 1, wherein the boron compounds (b) are selected from boric acid [$H_3BO_3$], sodium borates, boric anhydride [$B_2O_3$], borosilicate glass, and mixtures thereof.

6. The composition according to claim 1, wherein the boron compound (b) contains a proportion of sodium borate selected from sodium tetraborate and its hydrate stages [$Na_2B_4O_7$ x $H_2O$], in particular anhydrous tetraborate [$Na_2B_4O_7$], sodium tetraborate pentahydrate [$Na_2B_4O_7 \cdot 5H_2O$], [$Na_2B_4O_5(OH)_4 \cdot 8H_2O$], sodium tetraborate decahydrate [$Na_2B_4O_7 \cdot 10H_2O$], sodium metaborate [$NaBO_2 \cdot 4H_2O$], and mixtures thereof.

7. The composition according to claim 1, wherein the proportion of alkali or alkaline earth sulphate (c) is 15 to 25% by weight of the mixture.

8. The composition according to claim 1, wherein the fatty acid or the fatty acid salt (d) is selected from saturated and unsaturated fatty acids having 6 to 26 carbon atoms or their salts and mixtures thereof, with the proviso that the fatty acid or the fatty acid salt is present as a solid at 30° C.

9. The composition according to claim 1, wherein the fatty acid or the fatty acid salt (d) is selected from caproic acid, caprylic acid, capric acid, lauric acid, myristic acid, palmitic acid, margaric acid, stearic acid, arachidic acid, behenic acid, lignoceric acid, cerotic acid, palmitoleic acid, oleic acid, elaidic acid, vaccenic acid, eicosenoic acid, erucic acid, nervonic acid, linoleic acid, linolenic acid, arachidonic acid, timnodonic acid, clupanodonic acid, etc., their salts, and mixtures thereof.

10. The composition according to claim 1, wherein in addition to the constituents (a) to (d), the mixture contains, as the constituent (e1), up to 10% by weight of secondary or tertiary calcium phosphate compound, hydroxyapatite, or a mixture thereof, and/or as the constituent (e2) up to 15% by weight of graphite.

11. The composition according to claim 10, wherein the calcium phosphate compound (e1) is selected from hydroxyapatite [$Ca_5(PO_4)_3OH$], tricalcium phosphate [$Ca_3(PO_4)_2$], and mixtures thereof.

12. A method comprising applying the composition according to claim 1 to metal in powder form or granule form during lubricating and/or descaling in the hot processing of metals.

13. The composition according to claim 1, wherein the proportion of condensed alkali phosphate (a) is 30 to 50% by weight of the mixture.

* * * * *